US005185228A

United States Patent [19]

Maeda et al.

[11] Patent Number: 5,185,228

[45] Date of Patent: Feb. 9, 1993

[54] ELECTROPHOTOSENSITIVE MATERIAL CONTAINING P-BENZYLBIPHENYL

[75] Inventors: Tatsuo Maeda, Kobe; Masato Katsukawa, Ibaraki; Hiroaki Iwasaki, Hirakata; Yasufumi Mizuta, Kishiwada, all of Japan

[73] Assignee: Mita Industrial Co., Ltd., Osaka, Japan

[21] Appl. No.: 567,057

[22] Filed: Aug. 14, 1990

[30] Foreign Application Priority Data

| | | | |
|---|---|---|---|
| Aug. 17, 1989 | [JP] | Japan | 1-212444 |
| Aug. 17, 1989 | [JP] | Japan | 1-212445 |
| Aug. 17, 1989 | [JP] | Japan | 1-212446 |
| Aug. 17, 1989 | [JP] | Japan | 1-212447 |
| Aug. 18, 1989 | [JP] | Japan | 1-213197 |

[51] Int. Cl.[5] ..... G03G 5/09

[52] U.S. Cl. ..... 430/59; 430/56; 430/58; 430/72

[58] Field of Search ..... 430/59, 56, 58, 72

[56] References Cited

U.S. PATENT DOCUMENTS

| | | | |
|---|---|---|---|
| 4,250,237 | 2/1981 | Vickers | 430/17 |
| 4,877,702 | 10/1989 | Miyamoto et al. | 430/59 |
| 5,004,662 | 4/1991 | Mutoh et al. | 430/59 |

FOREIGN PATENT DOCUMENTS

| | | |
|---|---|---|
| 1909742 | 9/1969 | Fed. Rep. of Germany . |
| 38648 | 5/1960 | Luxembourg . |

OTHER PUBLICATIONS

Patent Abstracts of Japan, vol. 8, No. 245 (P-312) (1682), Jul. 10, 1984, Corresponds to JP-A-59 119355.

*Primary Examiner*—Marion E. McCamish
*Assistant Examiner*—Mark A. Chapman
*Attorney, Agent, or Firm*—Beveridge, DeGrandi, Weilacher & Young

[57] ABSTRACT

The present invention provides an electrophotosensitive material having a layer containing a binding resin, a charge transferring material and a biphenyl derivative of the following formula [I], or a compound of which energy level in a triplet state is not more than the energy level in an excited state of the charge transferring material. The present invention prevents the charge transferring material from being decreased in charge amount and sensitivity due to light irradiation:

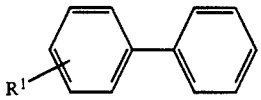

[I]

wherein $R^1$ is an aryl or aralkyl group.

12 Claims, No Drawings

ELECTROPHOTOSENSITIVE MATERIAL CONTAINING P-BENZYLBIPHENYL

BACKGROUND OF THE INVENTION

The present invention relates to an electrophotosensitive material used in an image forming apparatus such as an electrophotographic copying apparatus or the like.

As the electrophotosensitive material, there is recently used a function-separated type electrophotosensitive material in which the charge generating function and the charge transferring function are respectively achieved, as separated from each other, by a charge generating material for electric charge generating with exposure to light and a charge transferring material for transferring a generated charge. In such function-separated type electrophotosensitive material, it is easy to enhance the charge generating function to improve the sensitivity.

As examples of the function-separated type electrophotosensitive material above-mentioned, there are available (i) a multilayer type photosensitive layer unit having a charge generating layer containing a charge generating material and a charge transferring layer containing a charge transferring material, and (ii) a single-layer type photosensitive layer containing both a charge generating material and a charge transferring material.

Examples of the function-separated type electrophotosensitive material above-mentioned, include (i) an organic electrophotosensitive material using, as a photosensitive layer of a multilayer type or single-layer type photosensitive layer unit, an organic layer containing, in binding resin, functional components such as a charge generating material, a charge transferring material and the like, and (ii) a composite-type electrophotosensitive material in which the organic layer above-mentioned, a semiconductor thin film and the like are combined to form a multilayer type photosensitive layer unit. The electrophotosensitive materials above-mentioned are suitably used since they have a variety of choices for materials to be used and present good productivity and high degree of freedom for function designing.

However, there is the likelihood that the organic photosensitive layer in the organic electrophotosensitive material or composite-type electrophotosensitive material is decreased in charge amount, sensitivity and the like when an image forming process of charging, light exposure, charge eliminating and the like is repeated.

To prevent such a decrease in charge amount, sensitivity and the like, there have been proposed (i) an electrophotosensitive material using, in addition to a normal charge transferring material, another charge transferring material of an m-phenylenediamine compound excellent in properties for preventing a decrease in charge amount, sensitivity and the like, and (ii) an electrophotosensitive material using the m-phenylenediamine compound above-mentioned together with a perylene compound (a charge generating material) also excellent in properties for preventing a decrease in charge amount, sensitivity and the like.

However, the organic electrophotosensitive material or composite-type electrophotosensitive material containing the m-phenylenediamine compound and the like presents the problem of sudden decrease in sensitivity when the electrophotosensitive material is irradiated by light from a fluorescent lamp, a halogen lamp, a xenon lamp, the sun or the like, particularly at the time when the electrophotosensitive material is heated, for example, during the operation of the image forming apparatus.

Such a decrease in charge amount and sensitivity due to repeated light exposures or such a sudden decrease in sensitivity due to light irradiation is considered to be caused by the fact that the charge transferring material absorbs visible light or ultraviolet rays contained in the irradiated light, causing the charge transferring material to be excited, or that the charge transferring material is excited by an energy transmitted from other light absorbing substance such as the charge generating material or the like. This produces a dimerization or decomposition reaction, causing the charge transferring material to be changed to a substance acting as a carrier trap to decrease the sensitivity of the electrophotosensitive material.

SUMMARY OF THE INVENTION

It is a main object of the present invention to provide an electrophotosensitive material which hardly presents a decrease in charge amount or sensitivity due to repeated light exposures, and a sudden decrease in sensitivity due to light irradiation.

The present invention provides an electrophotosensitive material having a layer containing a binding resin, a charge transferring material and a biphenyl derivative represented by the following formula [I]:

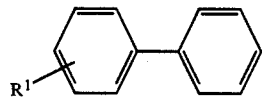

wherein $R^1$ is an aryl or aralkyl group

The present invention provides, as another embodiment thereof, an electrophotosensitive material having a layer containing a binding resin, a charge transferring material and a compound of which energy level in a triplet state is not more than the energy level in an excited state of the charge transferring material.

In the electrophotosensitive material of the present invention having the structure above-mentioned, the biphenyl derivative represented by the formula [I] takes an excitation energy of the charge transferring material as excited by light irradiation. This prevents the charge transferring material from being changed, as dimerized or decomposed, to a substance acting as a carrier trap to decrease the sensitivity of the electrophotosensitive material.

In the electrophotosensitive material according to another embodiment of the present invention, the predetermined compound takes an excitation energy from the charge transferring material as excited by light irradiation. This prevents the charge transferring material from being changed, as dimerized or decomposed, to a substance acting as a carrier trap to decrease the sensitivity of the electrophotosensitive material, likewise in the electrophotosensitive material above-mentioned.

The biphenyl derivative and the predetermined compound may partly contain a common compound. More specifically, there may be contained a substance which is a biphenyl derivative and of which energy level in a triplet state is not more than the energy level in an excited state of the charge transferring material.

DETAILED DESCRIPTION OF THE INVENTION

In the biphenyl derivative represented by the formula [I], examples of the aryl group corresponding to the substituting group $R^1$ include a phenyl group, a tolyl group, a xylyl group, a biphenyl group, a naphthyl group, an anthryl group and a phenanthryl group. The aryl group may contain a substituting group.

As the aralkyl group, there may be mentioned a group in which a hydrogen atom of a lower alkyl group having 1 to 4 carbon atoms such as a methyl group, an ethyl group, an n-propyl group, an isopropyl group, an n-butyl group is being substituted with the aryl group. In the aralkyl group, the aryl group may have a substituting group. An example of the substituting group includes the lower alkyl group above-mentioned, a halogen atom, a lower alkoxy group such as a methoxy group, an ethoxy group or the like.

Examples of the biphenyl derivative include P-benzylbiphenyl, o-terphenyl, m-terphenyl and p-terphenyl or the like. Parabenzyl biphenyl is preferable in view of its easiness of access and handling and the like.

As the predetermined compound of which energy level in a triplet state is not more than the energy level in an excited state of the charge transferring material, any of a variety of compounds may be used as selected according to the charge transferring material actually used. If the energy level of the predetermined compound in a triplet state is more than the energy level in an excited state of the charge transferring material, the compound gives an energy for dimerization or decomposition to the charge transferring material. This rather accelerates the deterioration of the charge transferring material by light irradiation. It is therefore required that the energy level of the predetermined compound in a triplet state is not more than the energy level in an excited state of the charge transferring material.

No particular restrictions are imposed on the lower limit of the energy level in a triplet state of the predetermined compound. However, such a lower limit is preferably not less than 86% of the energy level in an excited state of the charge transferring material. If the energy level of the predetermined compound in a triplet state is less than 86% of the energy level in an excited state of the charge transferring material, the energy gap becomes great so that the predetermined compound cannot take the excitation energy from the charge transferring material as excited by light irradiation.

For example, when m-phenylenediamine is used as the charge transferring material, the expected energy level in an excited state of the m-phenylenediamine is about 68.5+/−0.5 kcal/mol. In this case, there may be suitably used, as the predetermined compound, naphthalene, phenanthrene, m-terphenyl, biphenyl or fluorene of which energy level in a triplet state is the range of 60 to 68 kcal/mol. The value of energy level in a triplet state refers to a value as measured in a nonpolar solvent such as saturated hydrocarbon, benzene or the like.

The content of the biphenyl derivative or predetermined compound in the layer is not particularly limited to a certain range. However, such a content is preferably in a range from 5 to 60 parts by weight, more preferably from 5 to 40 parts by weight, for 100 parts by weight of binding resin. When the content is less than 5 parts by weight, it may not be assured to sufficiently prevent not only a decrease in charge amount or sensitivity by repeated light exposures, but also a sudden decrease in sensitivity by light irradiation. When the content is more than 60 parts by weight, the charging ability of the electrophotosensitive material may be decreased.

When the m-phenylenediamine compound is used as the charge transferring material, the content of the biphenyl derivative or predetermined compound is preferably in a range from 20 to 150 parts by weight for 100 parts by weight of the m-phenylenediamine compound. When the content is less than 20 parts by weight, it may not be assured to sufficiently prevent the m-phenylenediamine compound from being deteriorated by light irradiation. When the content is more than 150 parts by weight, the glass transition temperature of photosensitive layer is decreased, thereby to lower the heat resistance of the electrophotosensitive material.

As the charge transferring material contained in the layer together with the biphenyl derivative or predetermined compound, there may be used a variety of conventional charge transferring materials such as compounds containing electron donative group or electron attractive group such as a nitro group, a nitroso group, a cyano group or the like.

Examples of the charge transferring material include: tetracyanoethylene; a fluorenone compound such as 2,4,7-trinitro-9-fluorenone; a nitro compound such as 2,4,8-trinitrothioxanthone, dinitroanthracene or the like; a fluorene compound such as 9-carbazolylimino-fluorene or the like; succinic anhydride, maleic anhydride; dibromomaleic anhydride; a triphenylmethane compound; a diamino biphenyl compound such as 3,3'-dimethyl-4,4'-bis[N,N'-di(4-methylphenyl)amino]biphenyl or the like; an m-phenylenediamine compound such as N,N,N',N'-tetrakis(3-tolyl)-1,3-phenylene diamine or the like; a diamino triphenyl compound such as 4,4',4''-tris(N,N-diphenylamino)triphenylamine or the like; a hydrazone compound such as 4-(N,N-diethyl amino)-benzaldehyde-N,N-diphenyl hydrazone, N-methyl-3-carbazolylaldehyde-N,N-diphenyl hydrazone or the like; a styryl compound such as 9-(4-diethylaminostyryl)anthracene or the like; a conjugated unsaturated compound such as: 1,1-bis(4-diethyl- aminophenyl)-4,4-diphenyl-1,3-butadiene or the like; a nitrogen-containing heterocyclic compound such as an indole compound, an oxazole compound, an isoxazole compound, a thiazole compound, a thiadiazole compound, an oxadiazole compound [such as 2,5-di(4-dimethyl aminophenyl)1,3,4-oxadiazole], an imidazole compound, a pyrazole compound, a pyrazoline compound such as 1-phenyl-3-(p-dimethyl aminophenyl)pyrazoline], a triazole compound or the like; a condensed polycyclic compound such as anthracene, pyrene, phenanthrene or the like; a polymer material having photoconductivity such as poly-N-vinyl carbazole, polyvinyl pyrene, polyvinyl anthracene, ethylcarbazole formaldehyde resin or the like. Out of the examples of the charge transferring material above-mentioned, the polymer material having photoconductivity such as poly-N-vinyl carbazole or the like may be used also as the binding resin. The examples of the charge transferring material above-mentioned may be used alone or in combination of plural types.

Among the examples of the charge transferring material above-mentioned, the m-phenylenediamine compound represented by the following formula [II] may be preferably used in view of its excellent properties for preventing the decrease in charge amount, sensitivity or the like, as mentioned earlier.

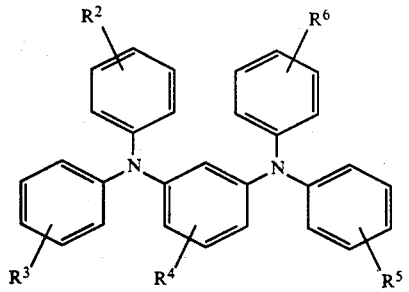

wherein $R^2$, $R^3$, $R^4$, $R^5$ and $R^6$ are the same or different, alkyl group, alkoxy group, halogen atom or hydrogen atom.

Examples of the m-phenylenediamine compound include, in addition to N,N,N',N'-tetrakis(3-tolyl)-1,3-phenylenediamine, N,N,N',N'-tetraphenyl-1,3-phenylenediamine, N,N,N',N'-tetraphenyl-3,5-tolylenediamine, N,N,N',N'-tetrakis(3-tolyl)-3,5-tolylenediamine, N,N,N',N'-tetrakis(4-tolyl)-1,3-phenylenediamine, N,N,N',N'-tetrakis(4-tolyl)-3,5-tolylenediamine, N,N,N',N'-tetrakis(3-ethylphenyl)-1,3-phenylenediamine, N,N,N',N'-tetrakis(4-propylphenyl)-1,3-phenylenediamine, N,N,N',N'-tetraphenyl-5-methoxy-1,3-phenylenediamine, N,N-bis(3-tolyl)-N',N'-diphenyl- 1,3-phenylenediamine, N,N'-bis(4-tolyl -N,N'-diphenyl-1,3-phenylenediamine, N,N'-bis(4-tolyl)-N,N'-bis(3-tolyl)-1,3-phenylenediamine, N,N'-bis(4-tolyl)-N,N'-bis(3-tolyl)-3,5-tolylenediamine, N,N'-bis(4-ethylphenyl)-N,N'-bis(3-ethylphenyl)-1,3-phenylenediamine, N,N'-bis(4-ethylphenyl)-N,N'-bis(3-ethylphenyl)-3,5-tolylenediamine, N,N,N',N'-tetrakis(2,4,6-trimethylphenyl)-1,3-phenylenediamine, N,N,N',N'-tetrakis(2,4,6-trimethylphenyl)3,5-tolylenediamine, N,N,N',N'-tetrakis(3,5-dimethylphenyl)1,3-phenylenediamine, N,N,N',N'-tetrakis(3,5-dimethylphenyl)-3,5-tolylenediamine, N,N,N',N'-tetrakis(3,5-diethylphenyl)-1,3-phenylenediamine, N,N,N',N'-tetrakis(3,5-diethylphenyl)-3,5-tolylenediamine, N,N,N',N'-tetrakis(3-chlorophenyl)-1,3-phenylenediamine, N,N,N',N'-tetrakis(3-bromophenyl)-1,3-phenylenediamine, N,N,N',N'-tetrakis(3-iodophenyl)-1,3-phenylenediamine, N,N,N',N'-tetrakis(3-fluorophenyl)-1,3-phenylenediamine and the like.

Out of the examples of the m-phenylenediamine compound above-mentioned, it is preferable to use, in the present invention, a compound in which the groups $R^2$, $R^3$, $R^4$, $R^5$ and $R^6$ in the formula [II] are substituted at the meta-position to the nitrogen atom, or in which the groups $R^2$ and $R^6$ are substituted at the para-position to the nitrogen atom and the groups $R^3$ and $R^5$ are substituted at the meta-position to the nitrogen atom. These compounds are hard to crystallize, and are enough dispersed in the binding resin for the reason of low mutual interaction of molecules of these compounds due to inferiority in symmetry of molecular structure. Examples of such a compound include N,N,N',N'-tetrakis(3-tolyl)-1,3-phenylenediamine, N,N'-bis(4-tolyl)-N,N'-bis(3-tolyl)-1,3-phenylenediamine.

The examples of the m-phenylenediamine compound above-mentioned may be used alone as the charge transferring material. However, such compounds are preferably jointly used together with the charge transferring material of which examples have been mentioned earlier.

No particular restrictions are imposed on the mixing ratio (M/T) of the m-phenylenediamine compound (M) to other charge transferring material (T). However, such a ratio M/T by weight is preferably in a range from 75/25 to 5/95 and more preferably from 50/50 to 20/80. When the ratio M/T is less than 5/95, this may considerably lower the effect of preventing the decrease in charge amount, sensitivity or the like at the time when the image forming process is repeated. When the ratio M/T is more than 75/25, the electrophotosensitive material may not be provided with sufficient sensitivity.

The structure of the present invention may be applied to each of electrophotosensitive materials having a variety of photosensitive layers each including a layer which contains the charge transferring material in the binding resin. For example, any of the following layers may contain the charge transferring material and the biphenyl derivative or the predetermined compound.

(1) A single-layer type organic photosensitive layer containing the binding resin, the charge transferring material and the charge generating material,
(2) The charge transferring layer containing the binding resin and the charge transferring material, out of the multilayer type organic photosensitive layer unit, and
(3) The organic charge transferring layer containing the binding resin and the charge transferring material, out of the composite-type photosensitive layer unit comprising the charge-generating layer made of a thin film of a semiconductor material and the organic charge transferring layer above-mentioned.

The organic layers such as the above-mentioned layers, a charge-generating layer of the multilayer type organic photosensitive layer unit and a surface protective layer may be formed, as necessary, top surface of the photosensitive layer formed a binding resin. Examples of the binding resin forming each of the organic layers above-mentioned include: thermosetting silicone resin; epoxy resin; urethane resin; thermosetting acrylic resin; alkyd resin; unsaturated polyester resin; diallylphthalate resin; phenol resin; urea resin; benzoguanamine resin; melamine resin; a styrene polymer; an acrylic polymer; a styrene-acryl copolymer; a styrene-butadiene copolymer; a styreneacrylonitrile copolymer; a styrene-maleic acid copolymer; an olefin polymer such as polyethylene, an ethylene-vinyl acetate copolymer, chlorinated polyethylene, polypropylene, ionomer or the like; polyvinyl chloride; a vinyl chloride-vinyl acetate copolymer; polyvinyl acetate; saturated polyester; polyamide; thermoplastic urethane resin; polycarbonate; polyallylate; polysulfone; ketone resin; polyvinyl butyral; polyether; photosetting resin such as epoxy-acrylate, uretane-acrylate or the like. These examples of the binding resin may be used alone or in combination of plural types.

In the composite-type photosensitive layer unit, there may be used, as the semiconductor material forming the thin film to be used as the charge generating layer, an amorphous chalcogenide such as $\alpha$-Se, $\alpha$-$As_2Se_3$, $\alpha$-SeAsTe or the like, and amorphous silicon ($\alpha$-Si). The charge generating layer in the form of a thin film made of the semiconductor material above-mentioned may be formed on the surface of a conductive substrate by a conventional thin-film forming method such as vacuum deposition method, glow-discharge decomposition method or the like.

Examples of an organic or inorganic charge generating material to be used in the single-layer type organic photosensitive layer or the charge generating layer in the multilayer type organic photosensitive layer unit, include: powder of the semiconductor material above-mentioned; a fine crystal of the II–VI group compound such as ZnO, CdS or the like; pyrylium salt; an azo compound; a bisazo compound; a phthalocyanine compound having α-type, β-type or γ-type crystal form such as aluminium phthalocyanine, copper phthalocyanine, metal-free phthalocyanine, titanyl phthalocyanine or the like; an anthanthrone compound; an indigo compound; a triphenyl methane compound; an indanthrene compound; a toluidine compound; a pyrazoline compound; a perylene compound; a quinacridone compound; a pyrrolopyrrole compound or the like. These examples of the charge generating material may be used alone or in combination of plural types.

According to the present invention, the perylene compound represented by the following formula [III] is preferably used in view of its excellent properties for preventing the decrease in charge amount and sensitivity as mentioned earlier:

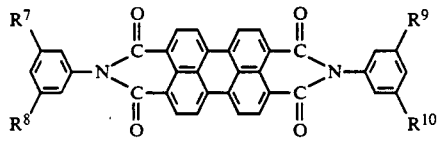

wherein $R^7$, $R^8$, $R^9$ and $R^{10}$ are the same or different, alkyl group.

As $R^7$ to $R^{10}$, there may be used the alkyl group having 1 to 6 carbon atoms, of which examples include a methyl group, an ethyl group, an n-propyl group, an isopropyl group, an n-butyl group, an isobutyl group, a tert-butyl group, a pentyl group and a hexyl group.

Examples of the perylene compound include N,N'-di(3,5-dimethylphenyl)perylene-3,4,9,10-tetracarboxydiimide, N,N'-di(3-methyl-5-ethylphenyl)perylene-3,4,9,10-tetracarboxydiimide, N,N'-di(3,5-diethylphenyl)perylene-3,4,9,10-tetracarboxydiimide, N,N'-di(3,5-dinormalpropylphenyl)perylene-3,4,9,10-tetracarboxydiimide, N,N'-di(3,5-diisopropylphenyl)perylene-3,4,9,10-tetracarboxydiimide, N,N'-di(3-methyl-5-isoprophenyl)perylene-3,4,9,10-tetracarboxydiimide, N,N'-di(3,5-dinormalbutylphenyl)perylene-3,4,9,10-tetracarboxydiimide, N,N'-di(3,5-di-tert-butylphenyl)-perylene-3,4,9,10-tetracarboxydiimide, N,N'-di(3,5-dipenthylphenyl)perylene-3,4,9,10-tetracarboxydiimide, N,N'-di(3,5-dihexylphenyl)perylene-3,4,9,10-tetracarboxydiimide or the like. Among the examples above-mentioned, N,N'-di(3,5-dimethylphenyl)perylene-3,4,9,10-tetracarboxydiimide is preferable in view of its easiness of access.

These examples of the perylene compound present no spectro-sensitivity at the long wavelength of light. Accordingly, to increase the sensitivity of the electrophotosensitive material at the time when a halogen lamp having a high red spectro- energy is combined, it is preferable to jointly use a charge generating material having sensitivity at the long wavelength of light, such as X-type metal-free phthalocyanine or the like.

A variety of examples of the X-type metal-free phthalocyanine may be used. Particularly preferable is one which presents a strong diffraction peaks at Bragg scattering angle ($2\theta+/-0.2°$) in an x-ray diffraction spectrum of 7.5°, 9.1°, 16.7°, 17.3° and 22.3°.

The mixing ratio of the X-type metal-free phthalocyanine is not limited to a certain range. However, such a mixing ratio is preferably in a range from 1.25 to 3.75 parts by weight for 100 parts by weight of the perylene compound. When the mixing ratio is less than 1.25 parts by weight, this assures no sufficient improvement in sensitivity at the long wavelength of light. With the mixing ratio is more than 3.75 parts by weight, the spectro-sensitivity at the long wavelength of light is too high. This involves the likelihood that the reproducibility of a red color original is decreased.

In the single-layer type organic photosensitive layer out of the photosensitive layer of the types mentioned earlier, the content of the charge generating material is preferably in a range from 2 to 20 parts by weight, more preferably from 3 to 15 parts by weight, for 100 parts by weight of the binding resin. The content of the charge transferring material is preferably in a range from 40 to 200 parts by weight, more preferably from 50 to 100 parts by weight, for 100 parts by weight of the binding resin. If the content of the charge generating material is less than 2 parts by weight or the content of the charge transferring material is less than 40 parts by weight, the sensitivity of the electrophotosensitive material may be insufficient or the residual potential may be great. On the other hand, if the content of the charge generating material is more than 20 parts by weight or the content of the charge transferring material is more than 200 parts by weight, the wear resistance of the electrophotosensitive material may be insufficient. When the m-phenylenediamine compound and other charge transferring material are jointly used as the charge transferring material, it is preferred that the content of said other charge transferring material with respect to the binding resin is set to the range above-mentioned and that the content of the m-phenylenediamine compound is set to a value determined based on the mixing ratio of the m-phenylenediamine compound to said other charge transferring material.

No particular restrictions are imposed on the thickness of the single-layer type organic photosensitive layer. However, such a thickness is preferably in a range from 5 to 60 μm and more preferably from 10 to 30 μm, likewise in a conventional single-layer type organic photosensitive layer.

In the layers forming the multilayer type organic photosensitive layer unit, the content of the charge generating material in the organic charge generating layer is preferably in a range from 5 to 500 parts by weight, more preferably from 10 to 250 parts by weight, for 100 parts by weight of the binding resin. When the content of the charge generating material is less than 5 parts by weight, the charge generating ability may be insufficient. On the other hand, the content is more than 500 parts by weight, involves the likelihood that the adhesion of the charge generating layer to the substrate or adjacent other layers is decreased.

No particular restrictions are imposed on the thickness of the charge generating layer. However, such a thickness is preferably in a range from 0.01 to 3 μm and more preferably from 0.1 to 2 μm.

In the layers forming the multilayer type organic photosensitive layer unit or the composite-type photosensitive layer unit, the content of the charge transferring material in the charge transferring layer is preferably in a range from 10 to 500 parts by weight, more preferably from 25 to 200 parts by weight, for 100 parts by weight of the binding resin. When the content of the charge transferring material is less than 10 parts by weight, the charge transferring ability may be insufficient. When such a content is more than 500 parts by weight, the mechanical strength of the charge transferring layer may be lowered. When the m-phenylenediamine compound and other charge transferring material are jointly used as the charge transferring material, it is preferred that the mixing ratio of said other charge transferring material to the binding resin is set to the range mentioned earlier and that the m-phenylenediamine compound is contained in the binding resin at the mixing ratio of the m-phenylenediamine compound to said other charge transferring material.

No particular restrictions are imposed on the thickness of the charge transferring layer. However, such a thickness is preferably in a range from 2 to 100 μm and more preferably from 5 to 30 μm.

The surface protective layer which may be formed on the top surface of each of the photosensitive layer units of the types mentioned earlier, is mainly composed of the binding resin above-mentioned, and may contain, as necessary, a suitable amount of an additive such as a conductivity imparting agent, a ultraviolet-ray absorbing agent of the benzoquinone type, or the like.

The thickness of the surface protective layer is preferably in a range from 0.1 to 10 μm and more preferably from 2 to 5 μm.

An antioxidant may be contained in the organic layer in each of the photosensitive layer units of the types mentioned earlier, and the surface protective layer. The antioxidant may prevent the deterioration due to oxidation of the functional components having a structure susceptible to influence of oxidation, such as the charge transferring material and the like.

An example of the antioxidant includes a phenol-type antioxidant such as 2,6-di-tert-butyl-p-cresol, triethyleneglycol-bis[3-(3-tert-butyl-5-methyl-4-hydroxyphenyl)propionate], 1,6-hexanediol-bis[3-(3,5-di-tert-butyl-4-hydroxyphenyl)propionate], pentaerythrityl-tetrakis[3-(3,5-di-tert-butyl-4-hydroxyphenyl)propionate], 2,2-thio-diethylenebis[3-(3,5-di-tert-butyl-4-hydroxyphenyl)propionate], 2,2-thio-bis(4-metyl-6-tert-butylphenol), N,N'-hexamethylene-bis(3,5-di-tert-butyl-4-hydroxy-hydrocyanoamide), 1,3,5-trimethyl-2,4,6-tris(3,5-di-tert-butyl-4-hydroxybenzyl)benzene.

Each of the photosensitive layer units of the types mentioned earlier is formed on the surface of a conductive substrate. The conductive substrate may be formed in a suitable shape such as a sheet, a drum or the like according to the mechanism and arrangement of an image forming apparatus in which the electrophotosensitive material is to be incorporated.

The conductive substrate may be wholly made of a conductive material such as metal or the like. Alternately, provision may be made such that the substrate itself is made of a non-conductive structural material and conductivity is given to the surface thereof.

As the conductive material to be used for the former-type conductive substrate, there may be preferably used aluminium which is anodized or not anodized, copper, tin, platinum, gold, silver, vanadium, molybdenum, chromium, cadmium, titanium, nickel, palladium, indium, stainless steel, brass and the like. More preferably, there may be used aluminium which has been anodized by a sulfate alumetizing method and of which holes have been sealed with nickel acetate.

As examples of the latter-type conductive substrate in which conductivity is being given to the surface of the substrate itself made of a non-conductive structural material, there may be mentioned (i) one in which a thin film made of a conductive material such as any of the metals above-mentioned, aluminium iodide, tin oxide, indium oxide or the like is formed on the surface of the substrate of synthetic resin or glass by a conventional thin film forming method such as vacuum deposition method, wet plating method or the like, (ii) one in which a film made of any of the metals above-mentioned is laminated on the surface of the substrate of synthetic resin or glass, and (iii) one in which a conductivity-imparting substance is doped onto the surface of the substrate of synthetic resin or glass.

As necessary, the conductive substrate may be subjected to surface treatment with a surface treating agent such as a silane coupling agent, a titanate coupling agent or the like, thereby to enhance the adhesion of the conductive substrate to the photosensitive layer unit.

The surface protective layer and the organic layers in each of the photosensitive layer units of the types mentioned earlier, may be formed, in lamination, by preparing layer solutions containing the components mentioned earlier, by successively applying such layer solutions onto the conductive substrate to form each of the lamination structures mentioned earlier, and by drying or curing the layer solutions thus applied.

In preparation of the solutions to be applied, various types of a solvent may be used according to the types of binding resins and the like to be used. Examples of the solvent include: aliphatic hydrocarbon such as n-hexane, octane, cyclohexane or the like; aromatic hydrocarbon such as benzene, xylene, toluene or the like; haloganated hydrocarbon such as dichloromethane, carbon tetrachloride, chlorobenzene, methylene chloride or the like; alcohol such as methyl alcohol, ethyl alcohol, isopropyl alcohol, allyl alcohol, cyclopentanol, benzyl alcohol, furfuryl alcohol, diacetone alcohol or the like; ether such as dimethyl ether, diethyl ether, tetrahydrofuran, ethylene glycol dimethyl ether, ethylene glycol diethyl ether, diethylene glycol dimethyl ether or the like; ketone such as acetone, methyl ethyl ketone, methyl isobutyl ketone, cyclohexanone or the like; ester such as ethyl acetate, methyl acetate or the like; dimethyl formamide; and dimethyl sulfoxide. These examples of the solvent may be used alone or in combination of plural types. At the time of preparation of the solutions to be applied, a surface active agent, a leveling agent or the like may be jointly used to improve the dispersibility, the applicability or the like.

The solutions to be applied may be prepared by a conventional method with the use of, for example, a mixer, a ball mill, a paint shaker, a sand mill, an attriter, a ultrasonic dispersing device or the like.

As thus described, according to the electrophotosensitive material of the present invention, the layer containing the charge transferring material also contains a biphenyl derivative having properties for preventing the charge transferring material from being deteriorated due to light irradiation, or a predetermined compound of which energy level in a triplet state is not more than the energy level in an excited state of the charge transferring material. Accordingly, the electrophotosensitive material of the present invention hardly presents a decrease in charge amount or sensitivity by repeated light exposures, or a sudden decrease in sensitivity by light irradiation.

EXAMPLES

The following description will discuss in more detail the present invention with reference to Examples thereof.

EXAMPLES 1 TO 11

To the following components, Biphenyl derivatives shown in the column of "BD" of Table 1 were mixed and dispersed by ultrasonic dispersing device to prepare coating solutions for single-layer type photosensitive layers. These coating solutions were applied to aluminum rolls, each having an outer diameter of 78 mm and a length of 340 mm and having an anodized surface layer. The rolls were heated and dried in a dark place at 100° C. for 30 minutes to form single-layer type photosensitive layers each having a thickness of about 24 μm, thus preparing drum-type electrophotosensitive materials.

| | |
|---|---|
| Charge generating material: | |
| (1) 4,10-dibromo-dibenzo[def, mno]chrysene-6,12-dione | 6 parts by weight |
| (2) X-type metal-free phthalocyanine (manufactured by Dainippon Ink Co., Ltd.) | 0.2 part by weight |
| Binding resin: | |
| Poly-(4,4'-cyclohexylidenediphenyl) carbonate (POLYCARBONATE Z manufactured by Mitsubishi Gas Kagaku Co., Ltd.) | 100 parts by weight |
| Charge transferring material: | |
| (1) 3,3'-dimethyl-4,4'-bis[N,N'-di(4-methylphenyl)amino]biphenyl | 63 parts by weight |
| (2) N,N,N',N'-tetrakis(3-tolyl)-1,3-phenylenediamine | 27 parts by weight |
| Antioxidant: | |
| 2,6-di-tert-butyl-p-cresol (ANTAGE BHT manufactured by Kawaguchi Kagaku Co., Ltd.) | 5 parts by weight |
| Plasticizer: | |
| Polydimethylsiloxane | 0.1 part by weight |
| Solvent: | |
| Tetrahydrofuran | 600 parts by weight |

In the Table 1, the abbreviations in the column labelled "BD" respectively refer to the following compounds (all compounds manufactured by Shin-Nittetsu Kagaku Co., Ltd.)

PBBP: p-benzylbiphenyl
o-TP: o-terphenyl
m-TP: m-terphenyl
p-TP: p-terphenyl

COMPARATIVE EXAMPLE 1

An electrophotosensitive material was prepared in the same manner as in Examples 1 to 11, except that the biphenyl derivative was not used.

COMPARATIVE EXAMPLE 2

An electrophotosensitive material was prepared in the same manner as in Comparative Example 1, except that N,N,N',N'-tetrakis(3-toryl)-1,3-phenylenediamine was not used and that 100 parts by weight of 3,3'-dimethyl-4,4'-bis[N,N'-di(4-methylphenyl)amino]biphenyl was used.

The electrophotosensitive materials of the Examples 1 to 11 and Comparative Examples 1 and 2 were examined as follows.

Test 1 (Measurement of initial surface potential)

Each electrophotosensitive material was set in the electrostatic test copier (Gentic Cincia 30M manufactured by Gentic Co.). With the surface of each electrophotosensitive material positively charged, the surface potential $V_1$ s.p.(V) was measured.

Test 2 (Measurement of half-life light exposure and residual potential)

Each electrophotosensitive material thus charged was exposed to a halogen lamp serving as the exposure light source of aforementioned electrostatic test copier. The time during which the surface potential $V_1$ s.p.(V) is reduced to a half, was then determined, and the half-life light exposure E $\frac{1}{2}$(μJ/cm$^2$) was calculated. The light exposure conditions were as follows:

Exposure time: 60 m second
Exposure intensity: 0.92 mW

Further, the surface potential after the passage of 0.15 second after the light exposure above-mentioned had started, was measured as a residual potential $V_1$ r.p.(V).

Test 3 (Measurement of variations of residual potential and surface potential after irradiation of ultraviolet rays)

At two points on the surface of each electrophotosensitive material, the surface potentials $V_e$ s.p.(V) and $V_n$ s.p.(V) and the residual potentials $V_e$ r.p.(V) and $V_n$ r.p (V) were measured in the same manner as in Tests 1 and 2 above-mentioned. Each electrophotosensitive material was preheated in a dark place at 60° C. for 20 minutes. With one point (at the $V_n$ side) of the two points above-mentioned masked with a light shield material and each electrophotosensitive material kept warm at 60° C., the surface of each electrophotosensitive material was irradiated for 20 minutes by white light of 1500 lux. containing ultraviolet rays, with the use of a white fluorescent lamp. Each electrophotosensitive material, after subjected to light irradiation, was left in a dark place at an ambient temperature for 30 minutes, and then cooled. Each electrophotosensitive material was set in the electrostatic test copier above-mentioned. With the surface positively charged, there were measured the surface potential $V_E$ s.p.(V) and the residual potential $V_E$ r.p.(V) at the exposed point of the two points above-mentioned, and the the surface potential $V_N$ s.p.(V) and the residual potential $V_N$ r.p.(V) at the light-shielded point.

With the use of the measured values thus obtained, a variation of the surface potential $\Delta V_{UV}$ s.p.(V) after irradiation of ultraviolet rays was calculated with the use of the following equation (a), and a variation of the residual potential $\Delta V_{UV}$ r.p.(V) after irradiation of ultraviolet rays was calculated with the use of the following equation (b).

$$\Delta V_{UV}\,s.p.(V)=(V_E s.p.-V_e s.p.)-(V_N s.p.-V_n s.p.) \quad (a)$$

$$\Delta V_{UV}\,r.p.(V)=(V_E r.p.-V_e r.p.)-(V_N r.p.-V_n r.p.) \quad (b)$$

Test 4 (Measurement of surface potential after repeated light exposures)

With each electrophotosensitive material set in the electrophotographic copying apparatus (Model DC-111 manufactured by Mita Kogyo Co., Ltd.) and 500 copies were taken. Each electrophotosensitive material was then set in the electrostatic test copier above-mentioned. With the surface of each electrophotosensitive material positively charged, the surface potential $V_2$ s.p.(V) after repeated light exposures was measured.

A variation of the surface potential $\Delta VR_R$s.p.(V) after repeated light exposures was calculated with the use of the following equation (c).

$$\Delta V_{Rs.p.}(V) = V_{2s.p.}(V) - V_{1s.p.}(V) \quad (c)$$

The test results are shown in Table 1.

TABLE 1

| | B D | Amount (parts) | $V_1$s.p. (V) | $E_{\frac{1}{2}}$ ($\mu$J/cm$^2$) | $V_1$r.p. (V) |
|---|---|---|---|---|---|
| Example 1 | PBBP | 5 | 705 | 5.9 | 195 |
| Example 2 | PBBP | 8 | 705 | 5.9 | 198 |
| Example 3 | PBBP | 12 | 715 | 5.7 | 190 |
| Example 4 | PBBP | 16 | 715 | 5.7 | 188 |
| Example 5 | PBBP | 20 | 720 | 5.5 | 183 |
| Example 6 | o-TP | 10 | 705 | 5.9 | 195 |
| Example 7 | o-TP | 20 | 720 | 5.7 | 189 |
| Example 8 | m-TP | 10 | 710 | 5.8 | 192 |
| Example 9 | m-TP | 20 | 720 | 5.6 | 189 |
| Example 10 | p-TP | 10 | 705 | 5.9 | 195 |
| Example 11 | p-TP | 20 | 725 | 5.6 | 188 |
| Comparative example 1 | — | — | 715 | 6.2 | 218 |
| Comparative example 2 | — | — | 723 | 6.0 | 202 |

| | $\Delta V_{UV}$s.p. (V) | $\Delta V_{UV}$r.p. (V) | $V_2$s.p. (V) | $\Delta V_R$s.p. (V) |
|---|---|---|---|---|
| Example 1 | +50 | +45 | 640 | −65 |
| Example 2 | +40 | +37 | 645 | −60 |
| Example 3 | +25 | +25 | 658 | −57 |
| Example 4 | +14 | +10 | 660 | −55 |
| Example 5 | +8 | +9 | 670 | −50 |
| Example 6 | +35 | +32 | 650 | −55 |
| Example 7 | +20 | +15 | 655 | −65 |
| Example 8 | +35 | +30 | 660 | −50 |
| Example 9 | +15 | +10 | 665 | −55 |
| Example 10 | +42 | +35 | 665 | −50 |
| Example 11 | +20 | +16 | 670 | −55 |
| Comparative example 1 | +75 | +58 | 680 | −35 |
| Comparative example 2 | +3 | +1 | 510 | −213 |

From the results shown in Table 1, it was found that the electrophotosensitive materials of Examples 1 to 11 jointly using the m-phenylenediamine-type charge transferring material and the biphenyl derivative, presented smaller variations of the surface potential and the residual potential by irradiation of ultraviolet rays, as compared with Comparative Example 1 containing no biphenyl derivative, so that the electrophotosensitive materials of Examples 1 to 11 have superior stability for irradiation of ultraviolet rays. It was also found that the electrophotosensitive materials of Examples 1 to 11 and Comparative Example 1 presented smaller variations of the surface potential by repeated light exposures, as compared with Comparative Example 2 jointly using no m-phenylenediamine compound as the charge transferring material, so that the biphenyl derivative exerted no influence upon such properties of the m-phenylenediamine compound as to prevent a decrease in charge amount, sensitivity or the like.

EXAMPLES 12 TO 22

To the following components, Biphenyl derivatives shown in the column labelled "BD" of Table 2 were mixed and dispersed by ultrasonic dispersing device to prepare coating solutions for single-layer type photosensitive layers. In the same manner as in Examples 1 to 11, there were prepared drum-type electrophotosensitive layer with thickness of about 24 $\mu$m.

| | |
|---|---|
| Charge generating material: | |
| (1) N,N'-di(3,5-dimethylphenyl)perylene-3,4,9,10-tetracarboxydiimide | 5 parts by weight |
| (2) X-type metal-free phthalocyanine (manufactured by Dainippon Ink Co., Ltd.) | 0.2 part by weight |
| Binding Resin: | |
| Poly-(4,4'-cyclohexylidenediphenyl) carbonate (POLYCARBONATE Z manufactured by Mitsubishi Gas Kagaku Co., Ltd.) | 100 parts by weight |
| Charge transferring material: | |
| (1) 3,3'-dimethyl-4,4'-bis[N,N'-di(4-methylphenyl)amino]biphenyl | 70 parts by weight |
| (2) N,N,N',N'-tetrakis(3-tolyl)-1,3-phenylenediamine | 30 parts by weight |
| Antioxidant: | |
| 2,6-di-tert-butyl-p-cresol (ANTAGE BHT manufactured by Kawaguchi Kagaku Co., Ltd.) | 5 parts by weight |
| Plasticizer: | |
| Polydimethylsiloxane | 0.01 part by weight |
| Solvent: | |
| Tetrahydrofuran | 600 parts by weight |

In the Table 2, the abbreviations in the column labelled "BD" are the same as in Table 1.

COMPARATIVE EXAMPLE 3

An electrophotosensitive material was prepared in the same manner as in Examples 12 to 22, except that the biphenyl derivative was not used.

COMPARATIVE EXAMPLE 4

An electrophotosensitive material was prepared in the same manner as in Comparative Example 3, except that the following charge generating material and the following charge transferring materials were used.

| | |
|---|---|
| Charge generating material: | |
| (1) 4,10-dibromo-dibenzo[def, mno]chrysene-6,12-dione | 5 parts by weight |
| (2) X-type metal-free phthalocyanine (manufactured by Dainippon Ink Co., Ltd.) | 0.2 part by weight |
| Charge transferring material: | |
| 3,3'-dimethyl-4,4'-bis[N,N'-di(4-methylphenyl)amino]biphenyl | 100 parts by weight |

Tests 1, 2 and 4 mentioned earlier were conducted on the electrophotosensitive materials of Examples 12 to 22 and Comparative Examples 3 and 4 above-mentioned.

Test 5 (Measurement of variations of residual potential and surface potential after irradiation of visible light)

At two points on the surface of each electrophotosensitive material, the surface potentials $V_e$ s.p.(V) and $V_n$ s.p (V) and the residual potentials $V_e$ r.p.(V) and $V_n$ r.p.(V) were measured in the same manner as in Tests 1 and 2 mentioned earlier. Each electrophotosensitive material was preheated in a dark place at 60° C. for 20 minutes. With one point (at the $V_n$ side) of the two points above-mentioned masked with a light shield material and each electrophotosensitive material kept warm at 60° C., the surface of each electrophotosensitive material was irradiated for 20 minutes by yellow light of 1500 lux. with the use of a yellow fluorescent lamp (NATIONAL COLORD FLUORESCENT LAMP FL40SY-F of 410W). Each electrophotosensitive material, after subjected to light irradiation, was left in a dark place at an ambient temperature for 30 minutes, and then cooled. Each electrophotosensitive material was set in the electrostatic test copier above-mentioned. With the surface positively charged, there were measured the surface potential $V_E$ s.p.(V) and the residual potential $V_E$ r.p.(V) at the exposed point of the two points above-mentioned, and the the surface potential $V_N$ s.p.(V) and the residual potential $V_N$ r p.(V) at the light-shielded point.

With the use of the measured values thus obtained, a variation of the surface potential $\Delta V_{VL}$ s.p.(V) after irradiation of visible light was calculated with the use of the following equation (d), and a variation of the residual potential $\Delta V_{VL}$ r.p.(V) after irradiation of visible light was calculated with the use of the following equation (e).

$$V_{VL}\ s.p. = (V_E\ s.p. - V_e\ s.p. - (V_N\ s.p. - V_n\ s.p. \quad \text{(d)}$$

$$V_{VL}\ r.p. = (V_E\ r.p. - V_e\ r.p.) - V_N\ r.p. - V_n\ r.p. \quad \text{(e)}$$

The test results are shown in Table 2.

TABLE 2

| | B D | Amount (parts) | $V_1$s.p. (V) | $E_{\frac{1}{2}}$ ($\mu$J/cm$^2$) | $V_1$r.p. (V) |
|---|---|---|---|---|---|
| Example 12 | PBBP | 5 | 720 | 5.9 | 195 |
| Example 13 | PBBP | 8 | 725 | 5.7 | 192 |
| Example 14 | PBBP | 12 | 730 | 5.7 | 192 |
| Example 15 | PBBP | 16 | 732 | 5.6 | 185 |
| Example 16 | PBBP | 20 | 735 | 5.4 | 183 |
| Example 17 | o-TP | 10 | 720 | 5.9 | 198 |
| Example 18 | o-TP | 20 | 725 | 5.7 | 194 |
| Example 19 | m-TP | 10 | 715 | 6.0 | 200 |
| Example 20 | m-TP | 20 | 720 | 5.7 | 193 |
| Example 21 | p-TP | 10 | 705 | 5.9 | 198 |
| Example 22 | p-TP | 20 | 725 | 5.6 | 195 |
| Comparative example 3 | — | — | 712 | 6.2 | 208 |
| Comparative example 4 | — | — | 723 | 6.0 | 202 |

| | $\Delta V_{VL}$s.p. (V) | $\Delta V_{VL}$r.p. (V) | $V_2$s.p. (V) | $\Delta V_R$s.p. (V) |
|---|---|---|---|---|
| Example 12 | +18 | +16 | 670 | −50 |
| Example 13 | +14 | +12 | 675 | −50 |
| Example 14 | +10 | +7 | 675 | −55 |
| Example 15 | +12 | +3 | 680 | −52 |
| Example 16 | +18 | −2 | 695 | −40 |
| Example 17 | +15 | +10 | 670 | −50 |
| Example 18 | +10 | +5 | 670 | −55 |
| Example 19 | +18 | +7 | 660 | −55 |
| Example 20 | +12 | +4 | 665 | −55 |
| Example 21 | +12 | +10 | 660 | −45 |
| Example 22 | +8 | +5 | 680 | −45 |
| Comparative example 3 | +14 | +23 | 685 | −27 |
| Comparative example 4 | +3 | +1 | 510 | −213 |

From the results shown in Table 2, it was found that variations of the surface potential due to irradiation of visible light in the electrophotosensitive materials of Examples 12 to 22 jointly using the perylene compound, the m-phenylenediamine compound and the biphenyl derivative, were equal to or smaller than those in Comparative Example 3 containing no biphenyl derivative. It was also found that variations of the residual potential due to irradiation of visible light in the electrophotosensitive materials of Examples 12 to 22 were considerably smaller than those in Comparative Example 3. Particularly, the residual potential after irradiation of visible light in Example 16 was not decreased but rather increased. From the foregoing, it was found that the electrophotosensitive materials of Examples 12 to 22 having superior stability for irradiation of visible light. It was also found that the electrophotosensitive materials of Examples 12 to 22 and Comparative Example 3 above-mentioned presented smaller variations of surface potential due to repeated light exposures, as compared with Comparative Example 4 using no perylene compound as the charge generating material and jointly using no m-phenylenediamine compound as the charge transferring material. From the foregoing, it was found that the biphenyl derivative exerted no influence upon such properties of the system jointly using the perylene compound and the m-phenylenediamine compound as to prevent a decrease in charge amount, sensitivity or the like.

EXAMPLES 23 TO 26 AND COMPARATIVE EXAMPLES 5 TO 8

To the following components, 20 parts by weight of the compounds having such energy levels in a triplet state as shown in Table 3 were mixed and dispersed by ultrasonic dispersing device to prepare coating solutions for single-layer type photosensitive layers. In the same manner as in Examples 1 to 11, there were prepared drum-type electrophotosensitive materials each having a single-layer type photosensitive layer with thickness of about 24 $\mu$m.

| | |
|---|---|
| Charge generating material: | |
| (1) 4,10-dibromo-dibenzo[def,mno]chrysene-6,12-dione | 8 parts by weight |
| (2) X-type metal-free phthalocyanine (manufactured by Dainippon Ink Co., Ltd) | 0.2 part by weight |
| Binding Resin: | |
| Poly-(4,4'-cyclohexylidenediphenyl) carbonate (POLYCARBONATE Z manufactured by Mitsubishi Gas Kagaku Co., Ltd.) | 100 parts by weight |
| Charge transferring material: | |
| (1) 3,3'-dimethyl-4,4'-bis[N,N'-di(4-methylphenyl)amino]biphenyl | 40 parts by weight |
| (2) N,N,N',N'-tetrakis(3-tolyl)-1,3-phenylenediamine | 40 parts by weight |
| Antioxidant: | |
| 2,6-di-tert-butyl-p-cresol (ANTAGE BHT manufactured by Kawaguchi Kagaku Co., Ltd.) | 5 parts by weight |
| Plasticizer: | |
| Polydimethylsiloxane | 0.1 part by weight |
| Solvent: | |
| Tetrahydrofuran | 600 parts by weight |

COMPARATIVE EXAMPLE 9

An electrophotosensitive material was prepared in the same manner as in Examples 23 to 26, except that the predetermined compound was not used.

COMPARATIVE EXAMPLE 10

An electrophotosensitive material was prepared in the same manner as in Comparative Example 9, except that N,N,N',N'-tetrakis(3-toryl)-1,3-phenylenediamine was not used and that 80 parts by weight of 3,3'-dimethyl- 4,4'-bis[N,N'-di(4-methylphenyl)amino]biphenyl was used.

Tests 1 to 4 mentioned earlier were conducted on the electrophotosensitive materials of Examples 23 to 26 and Comparative Examples 5 to 10 above-mentioned.

The test results are shown in Table 3.

TABLE 3

| | Compound | Energy level (kcal/mol) | $V_1$s.p. (V) |
|---|---|---|---|
| Example 23 | naphthalene | 60.9 | 718 |
| Example 24 | phenanthrene | 62.0 | 720 |
| Example 25 | biphenyl | 65.8 | 704 |
| Example 26 | fluorene | 67.9 | 730 |
| Comparative example 5 | anthracene | 42.7 | 706 |
| Comparative example 6 | pyrene | 48.1 | 712 |
| Comparative example 7 | benzophenone | 69.2 | 708 |
| Comparative example 8 | xanthone | 74.0 | 716 |
| Comparative example 9 | — | — | 710 |
| Comparative example 10 | — | — | 715 |

| | $E_{\frac{1}{2}}$ ($\mu$J/cm$^2$) | $V_1$r.p. (V) | $\Delta V_{UV}$s.p. (V) |
|---|---|---|---|
| Example 23 | 6.0 | 197 | +30 |
| Example 24 | 6.2 | 200 | +35 |
| Example 25 | 6.1 | 197 | +37 |
| Example 26 | 6.0 | 195 | +35 |
| Comparative example 5 | 6.3 | 202 | +58 |
| Comparative example 6 | 6.2 | 201 | +62 |
| Comparative example 7 | 6.8 | 207 | +100 |
| Comparative example 8 | 6.7 | 206 | +118 |
| Comparative example 9 | 6.0 | 199 | +60 |
| Comparative example 10 | 5.8 | 195 | +2 |

| | $\Delta V_{UV}$r.p. (V) | $V_2$s.p. (V) | $\Delta V_R$s.p. (V) |
|---|---|---|---|
| Example 23 | +18 | 695 | −23 |
| Example 24 | +21 | 690 | −30 |
| Example 25 | +19 | 685 | −19 |
| Example 26 | +12 | 700 | −30 |
| Comparative example 5 | +55 | — | — |
| Comparative example 6 | +60 | — | — |
| Comparative example 7 | +75 | — | — |
| Comparative example 8 | +102 | — | — |
| Comparative example 9 | +53 | 690 | −20 |
| Comparative example 10 | +1 | 480 | −235 |

From the results shown in Table 3, it was found that the surface potentials and residual potentials of the electrophotosensitive materials of Comparative Examples 5, 6 using the compounds of which energy levels in a triplet state were less than 60 kcal/mol, were decreased, by irradiation of ultraviolet rays, to the same extent as that of Comparative Example 9 containing no predetermined compound. It was also found that the surface potentials and residual potentials of the electrophotosensitive materials of Comparative Examples 7, 8 using the compounds of which energy levels in a triplet state more than the expected energy level in an excited state of the m-phenylenediamine (about 68.5 +/−0.5 kcal/mol), were considerably decreased, by irradiation of ultraviolet rays, to the extent exceeding that of Comparative Example 9. On the contrary, the electrophotosensitive materials of Examples 23 to 26 using the predetermined compounds of which energy levels in a triplet state were in the range of 60 to 68 kcal/mol, presented smaller variations of surface potential and residual potential by irradiation of ultraviolet rays, as compared with Comparative Examples 5 to 9. From the foregoing, it was found that the electrophotosensitive materials of Examples 23 to 26 having superior stability for irradiation of ultraviolet rays. It was also found that the electrophotosensitive materials of Examples 23 to 26 and Comparative Example 9 presented smaller variations of the surface potential due to repeated light exposures, as compared with Comparative Example 10 jointly using no m-phenylenediamine compound as the charge transferring materials. It was thus found that the compounds above-mentioned exerted no influence upon such properties of the m-phenylenediamine compound as to prevent a decrease in charge amount, sensitivity or the like.

EXAMPLES 27 TO 30 AND COMPARATIVE EXAMPLES 11 TO 14

To the following components, 20 parts by weight of the compounds having such energy levels in a triplet state as shown in Table 4 were mixed and dispersed by ultrasonic dispersing device to prepare coating solutions for single-layer type photosensitive layers. In the same manner as in Examples 1 to 11, there were prepared drum-type electrophotosensitive materials each having a single-layer type photosensitive layer with a thickness of about 24 $\mu$m.

| | |
|---|---|
| Charge generating material: | |
| (1) N,N'-di(3,5-dimethylphenyl)perylene-3,4,9,10-tetracarboxydiimide, | 8 parts by weight |
| (2) X-type metal-free phthalocyanine (manufactured by Dainippon Ink Co., Ltd) | 0.2 part by weight |
| Binding resin: | |
| Poly-(4,4'-cyclohexylidenediphenyl) carbonate (POLYCARBONATE Z manufactured by Mitsubishi Gas Kagaku Co., Ltd.) | 100 parts by weight |
| Charge transferring materials: | |
| (1) 3,3'-dimethyl-4,4'-bis[N,N'-di(4-methylphenyl)amino]biphenyl | 56 parts by weight |
| (2) N,N,N',N'-tetrakis(3-tolyl)-1,3-phenylenediamine | 24 parts by weight |
| Antioxidant: | |
| 2,6-di-tert-butyl-p-cresol (ANTAGE BHT manufactured by Kawaguchi Kagaku Co., Ltd.) | 5 parts by weight |
| Plasticizer: | |
| Polydimethylsiloxane | 0.01 part by weight |
| Solvent: | |
| Tetrahydrofuran | 600 parts by weight |

COMPARATIVE EXAMPLE 15

An electrophotosensitive material was prepared in the same manner as in Examples 27 to 30, except that the predetermined compound was not used.

COMPARATIVE EXAMPLE 16

An electrophotosensitive material was prepared in the same manner as in Comparative Example 15, except that the following charge generating materials and charge transferring materials were used.

| | |
|---|---|
| Charge generating material: | |
| (1) 4,10-dibromo-dibenzo[def, mno] chrysene-6,12-dione | 8 parts by weight |
| (2) X-type metal-free phthalocyanine (manufactured by Dainippon Ink Co., Ltd.) | 0.2 part by weight |
| Charge transferring material: | |
| 3,3'-dimethyl-4,4'-bis[N,N'-di(4-methylphenyl)amino]biphenyl | 100 parts by weight |

Tests 1, 2, 4 and 5 mentioned earlier were conducted on the electrophotosensitive materials of Examples 27 to 30 and Comparative Examples 11 to 16 above-mentioned.

The test results are shown in Table 4.

TABLE 4

| | Compound | Energy level (kcal/mol) | $V_1$s.p. (V) |
|---|---|---|---|
| Example 27 | naphthalene | 60.9 | 712 |
| Example 28 | phenanthrene | 62.0 | 702 |
| Example 29 | biphenyl | 65.8 | 712 |
| Example 30 | fluorene | 67.9 | 705 |
| Comparative example 11 | anthracene | 42.7 | 724 |
| Comparative example 12 | pyrene | 48.1 | 706 |
| Comparative example 13 | benzophenone | 69.2 | 709 |
| Comparative example 14 | xanthone | 74.0 | 719 |
| Comparative example 15 | — | — | 710 |
| Comparative example 16 | — | — | 715 |

| | $E_{\frac{1}{2}}$ ($\mu$J/cm$^2$) | $V_1$r.p. (V) | $\Delta V_{VL}$s.p. (V) |
|---|---|---|---|
| Example 27 | 5.9 | 199 | +50 |
| Example 28 | 5.6 | 189 | +43 |
| Example 29 | 5.7 | 193 | +65 |
| Example 30 | 5.7 | 193 | +56 |
| Comparative example 11 | 5.4 | 191 | +69 |
| Comparative example 12 | 5.3 | 175 | +70 |
| Comparative example 13 | 7.3 | 213 | +95 |
| Comparative example 14 | 7.4 | 213 | +110 |
| Comparative example 15 | 5.6 | 184 | +67 |
| Comparative example 16 | 5.8 | 195 | +2 |

| | $\Delta V_{VL}$r.p. (V) | $V_2$s.p. (V) | $\Delta V_R$s.p. (V) |
|---|---|---|---|
| Example 27 | +21 | 675 | −37 |
| Example 28 | +21 | 680 | −22 |
| Example 29 | +33 | 685 | −27 |
| Example 30 | +14 | 680 | −25 |
| Comparative example 11 | +55 | — | — |
| Comparative example 12 | +59 | — | — |
| Comparative example 13 | +98 | — | — |
| Comparative example 14 | +165 | — | — |
| Comparative example 15 | +56 | 680 | −30 |
| Comparative example 16 | +1 | 480 | −235 |

From the results shown in Table 4, it was found that the surface potentials and residual potentials of the electrophotosensitive materials of Comparative Examples 11, 12 using the compounds of which energy levels in a triplet state were less than 60 kcal/mol, were decreased, by irradiation of visible light, to the same extent as that of Comparative Example 15 containing no predetermined compound. It was also found that the surface potentials and residual potentials of the electrophotosensitive materials of Comparative Examples 13, 14 using the compounds of which energy levels in a triplet state are more than the expected energy level in an excited state of the m-phenylenediamine (about 68.5 +/−0.5 kcal/mol), were considerably decreased, by irradiation of visible light, to the extent exceeding that of Comparative Example 15. On the contrary, the electrophotosensitive materials of Examples 27 to 30 using the predetermined compounds of which energy levels in a triplet state were in the range of 60 to 68 kcal/mol, presented smaller variations of surface potential and residual potential by irradiation of visible light, as compared with Comparative Examples 11 to 15. From the foregoing, it was found that the electrophotosensitive materials of Examples 27 to 30 having superior stability for irradiation of visible light. It was also found that the electrophotosensitive materials of Examples 27 to 30 and Comparative Example 15 presented smaller variations of surface potential by repeated light exposures, as compared with Comparative Example 16 using no perylene compound as the charge generating material and jointly using no m-phenylenediamine compound as the charge transferring material. It was thus found that the predetermined compound above-mentioned exerted no influence upon such properties of the system jointly using the perylene compound and the m-phenylenediamine compound as to prevent a decrease in charge amount, sensitivity or the like.

EXAMPLES 31 TO 35

To the following components, such amounts as shown in Table 5 of p-benzylbiphenyl were mixed and dispersed by ultrasonic dispersing device to prepare coating solutions for single-layer type photosensitive layers. In the same manner as in Examples 1 to 11, there were prepared drum-type electrophotosensitive materials, each having a single-layer type photosensitive layer with a thickness of about 23 $\mu$m.

| | |
|---|---|
| Charge generating material: | |
| (1) N,N'-di(3,5-dimethylphenyl)perylene-3,4,9,10-tetracarboxydiimide, | 8 parts by weight |
| (2) X-type metal-free phthalocyanine (manufactured by Dainippon Ink Co., Ltd.) | 0.2 part by weight |
| Binding Resin: | |
| Poly-(4,4'-cyclohexylidenediphenyl) carbonate (POLYCARBONATE Z manufactured by Mitsubishi Gas Kagaku Co., Ltd.) | 100 parts by weight |
| Charge transferring materials: | |
| 3,3'-dimethyl-4,4'-bis[N,N'-di(4-methylphenyl)amino]biphenyl | 80 parts by weight |
| Antioxidant: | |
| 2,6-di-tert-butyl-p-cresol (ANTAGE BHT manufactured by Kawaguchi Kagaku Co., Ltd.) | 5 parts by weight |
| Plasticizer: | |
| Polydimethylsiloxane | 0.01 part by weight |
| Solvent: | |
| Tetrahydrofuran | 600 parts by weight |

COMPARATIVE EXAMPLE 17

An electrophotosensitive material was prepared in the same manner as in Examples 31 to 35, except that p-benzylbiphenyl was not used.

COMPARATIVE EXAMPLE 18

An electrophotosensitive material was prepared in the same manner as in Examples 31 to 35, except that 20 parts by weight of 2,3-dichloro-1,4-naphthoquinone was used instead of p-benzylbiphenyl.

EXAMPLE 36

The following components were mixed and dispersed by ultrasonic dispersing device to prepare a coating solution for charge-generating layer for a multilayer type photosensitive layer. This coating solution was applied to an aluminum roll having an outer diameter of 78 mm and a length of 340 mm and having an anodized surface layer. The roll was then heated and dried in a dark place at 100° C. for 30 minutes to form a charge-generating layer for multilayer type photosensitive layer having a thickness of about 0.2 μm.

| | |
|---|---|
| Charge generating material: | |
| Oxotitanilphthalocyanine | 100 parts by weight |
| Binding resin: | |
| Polyvinyl butyral (DENKABUTYRAL #500-A manufactured by Denki Kagaku Kogyo Co., Ltd.) | 100 parts by weight |
| Solvent: | |
| Tetrahydrofuran | 4000 parts by weight |

Then, the following components were mixed and dispersed by ultrasonic dispersing device to prepare a coating solution for charge transferring layer for a multilayer type photosensitive layer. This coating solution was applied onto the charge generating layer, and then heated and dried under conditions similar to those above-mentioned, thus forming a charge transferring layer having a thickness of about 20 μm. There was thus formed a drum-type electrophotosensitive material having a multilayer type photosensitive layer unit.

| | |
|---|---|
| Biphenyl derivative: | |
| p-benzylbiphenyl | 20 parts by weight |
| Binding resin: | |
| Poly-(4,4'-cyclohexylidenediphenyl) carbonate (POLYCARBONATE Z manufactured by Mitsubishi Gas Kagaku Co., Ltd.) | 100 parts by weight |
| Charge transferring material: | |
| 3,3'-dimethyl-4,4'-bis[N,N'-di(4-methylphenyl)amino]biphenyl | 100 parts by weight |
| Antioxidant: | |
| 2,6-di-tert-butyl-p-cresol (ANTAGE BHT manufactured by Kawaguchi Kagaku Co., Ltd.) | 5 parts by weight |
| Solvent: | |
| Benzene | 500 parts by weight |

COMPARATIVE EXAMPLE 19

An electrophotosensitive material was prepared in the same manner as in Example 36 except that 20 parts by weight of 2,3-dichloro-1,4-naphthoquinone was used instead of p-benzylbiphenyl.

The following Tests 6 to 8 were conducted on the electrophotosensitive materials of Examples 31 to 36 and Comparative Examples 17 to 19 above-mentioned.

Test 6 (Measurement of initial surface potential)

Each electrophotosensitive material was set in the electrostatic test copier mentioned earlier. The surface potential $V_1$ s.p.(V) was measured with the surface of each of the electrophotosensitive materials of Examples 31 to 35 and Comparative Examples 17, 18 positively charged and with the surface of each of the electrophotosensitive materials of Example 36 and Comparative Example 19 negatively charged.

Test 7 (Measurement of half-life light exposure and residual potential)

Each electrophotosensitive material thus charged was exposed to a halogen lamp serving as the exposure light source of the electrostatic test copier above-mentioned. The time during which the surface potential $V_1$ s.p.(V) was reduced to a half, was then determined, and the half-life light exposure E 1/2 ($\mu J/cm^2$) was calculated. The light exposure conditions were as follows:

Exposure time: 60 m second

Exposure intensity: 0.92 mW

Further, the surface potential after the passage of 0.4 second after the light exposure above-mentioned had started, was measured as a residual potential $V_1$ r.p.(V).

Test 8 (Measurement of residual potential after repeated light exposures)

With each electrophotosensitive material set in the electrophotographic copying apparatus (Model DC-111 manufactured by Mita Kogyo Co., Ltd.) and 1500 copies were taken. Each electrophotosensitive material was then set in the electrostatic test copier mentioned earlier. With the surface of each electrophotosensitive material positively or negatively charged, the surface potential $V_2$ s.p.(V) and residual potential $V_2$ r.p.(V) after repeated light exposures, were measured.

For each electrophotosensitive material, a variations of the surface potential $\Delta V_R$ s.p.(V) after repeated light exposures was calculated with the use of the following equation (f), and a variation of the residual potential $\Delta V_R$ r.p.(V) after repeated light exposures was calculated with the use of the following equation (g).

$$V_R\ s.p.(V) = V_2\ s.p\ (V) - V_1\ s.p.\ (V) \quad (f)$$

$$V_R\ r.p.(V) = V_2\ r.p\ (V) - V_1\ r.p.\ (V) \quad (g)$$

The test results are shown in Table 5.

TABLE 5

| | Amount (parts) | $V_1$s.p. (V) | $E_{\frac{1}{2}}$ ($\mu J/cm^2$) | $V_1$r.p. (V) |
|---|---|---|---|---|
| Example 31 | 8 | +670 | 5.11 | +156 |
| Example 32 | 20 | +670 | 5.11 | +155 |
| Example 33 | 30 | +650 | 5.07 | +148 |
| Example 34 | 40 | +630 | 4.92 | +143 |
| Example 35 | 55 | +550 | 4.85 | +137 |
| Example 36 | 20 | −730 | 4.55 | −89 |
| Comparative example 17 | — | +690 | 5.62 | +187 |
| Comparative example 18 | — | +670 | 5.00 | +150 |
| Comparative example 19 | — | −700 | 4.48 | −85 |
| | $V_2$s.p. | $V_2$r.p. | $\Delta V_R$s.p. | $\Delta V_R$r.p. |

TABLE 5-continued

| | (V) | (V) | (V) | (V) |
|---|---|---|---|---|
| Example 31 | +635 | +134 | −35 | −22 |
| Example 31 | +630 | +132 | −40 | −23 |
| Example 31 | +610 | +125 | −40 | −23 |
| Example 31 | +595 | +120 | −35 | −23 |
| Example 31 | +510 | +108 | −40 | −29 |
| Example 31 | −685 | −70 | +45 | +19 |
| Comparative example 17 | +630 | +100 | −60 | −87 |
| Comparative example 18 | +430 | +70 | −240 | −80 |
| Comparative example 19 | −470 | −50 | +230 | +35 |

From the results shown in Table 5, it was found that the electrophotosensitive materials of Examples 31 to 36 using p-benzylbiphenyl of a biphenyl derivative presented smaller variations of surface potential and residual potential after repeated light exposures, as compared with Comparative Example 17 containing no biphenyl derivative and Comparative Example 18, 19 containing a compound other than a biphenyl derivative. From the foregoing, it was found that the electrophotosensitive materials of Examples 31 to 36 having superior stability for light irradiation at the time of repeated light exposures. It was also found that the electrophotosensitive materials of Examples 31 to 36 presented higher sensitivity as compared with Comparative Example 17 containing no biphenyl derivative. It was thus found that the biphenyl derivative was effective to increase the sensitivity of the electrophotosensitive material.

What is claimed is:

1. An electrophotosensitive material comprising: a layer containing a binding resin, a charge transferring material and a p-benzylbiphenyl.

2. An electrophotosensitive material according to claim 1, wherein the charge transferring material is m-phenylenediamine.

3. An electrophotosensitive material according to claim 2, wherein the p-benzylbiphenyl is included in an amount of 20 to 150 parts by weight for 100 parts by weight of m-phenylenediamine.

4. An electrophotosensitive material according to claim 2, wherein the layer is a single-layer type photosensitive layer containing a charge generating material.

5. An electrophotosensitive material according to claim 4, wherein the charge generating material is a perylene compound.

6. An electrophotosensitive material according to claim 2, wherein the layer is a charge transferring layer forming a multilayer type photosensitive layer unit together with a charge generating layer.

7. An electrophotosensitive material according to claim 1, wherein said p-benzylbiphenyl is contained in an amount of 20 to 150 parts by weight for 100 parts by weight of charge transfer material.

8. An electrophotosensitive material according to claim 1, wherein the layer is a single-layer type photosensitive layer containing a charge generating material.

9. An electrophotosensitive material according to claim 8, wherein the charge generating material is a perylene compound.

10. An electrophotosensitive material according to claim 1, wherein the layer is a charge transferring layer forming a multilayer type photosensitive layer unit together with a charge generating layer.

11. An electrophotosensitive material comprising: a layer containing a binding resin, a charge transferring material and a p-benzylbiphenyl compound having an energy level in a triplet state which is 86 to 100% of the energy level in an excited state of said charge transferring material.

12. An electrophotosensitive material according to claim 9, wherein the charge transferring material is m-phenylenediamine and the energy level in the triplet state of said compound is in the range of 60 to 68 kcal/mol.

* * * * *